United States Patent [19]

Quinn et al.

[11] Patent Number: 4,530,389

[45] Date of Patent: Jul. 23, 1985

[54] RETRACTABLE AWNING WITH IMPROVED SET-UP CAPABILITY

[75] Inventors: Anthony W. Quinn, Westminster; Donald S. McKee, Louisville; Richard B. Rader, Thornton, all of Colo.

[73] Assignee: The Scott & Fetzer Company, Westlake, Ohio

[21] Appl. No.: 524,455

[22] Filed: Aug. 18, 1983

[51] Int. Cl.[3] ..... E04F 10/06

[52] U.S. Cl. ..... 160/46; 160/67; 160/299

[58] Field of Search ..... 160/66, 67, 68, 69, 160/72, 75, 298, 299, 317, 1, 46; 135/88, 89

[56] References Cited

U.S. PATENT DOCUMENTS

| | | | |
|---|---|---|---|
| 3,665,996 | 5/1972 | Roberts | 160/1 |
| 3,923,074 | 12/1975 | McKee | 160/68 |
| 4,161,204 | 7/1979 | Kurz | 160/1 |
| 4,171,013 | 10/1979 | Clark | 135/89 |
| 4,188,964 | 2/1980 | Green | 135/89 |

*Primary Examiner*—Peter M. Caun

*Attorney, Agent, or Firm*—Gary M. Polumbus

[57] ABSTRACT

A roll control mechanism of a retractable awning assembly includes spring clutches to operatively control the rotation of the roll bar in each of the two opposite rotational directions. Selective locking to prevent unrolling or extension of the canopy in one situation or to prevent the rolling or winding up of the canopy in another situation is achieved. A selector device for controlling the operation of the spring clutches is located on the support arm intermediate the top end connected to the roll bar and the bottom end adapted for contacting a support surface. Control of the roll control mechanism during set-up of the awning assembly is conveniently achieved. A support locking mechanism is also included within the selector device for fixing the length of two telescope support members of the support arm. Fixing the operative length occurs simultaneously as the roll control mechanism is controlled. An improved latching mechanism for connecting the bottom end of the support arm to a vertical support surface is manually actuated to selectively release the pivotable connection of the bottom end of the support arm, includes a shelf-like extension for guiding the support arm guiding end into a latching relationship, and includes a receptacle for receiving an outer end of the brace member to prevent a catch piece of the latching mechanism from disconnecting the bottom end of the support arm. The power wind-up spring of the awning assembly is formed from a sheet of spring material coiled radially within the roll bar.

36 Claims, 13 Drawing Figures

RETRACTABLE AWNING WITH IMPROVED SET-UP CAPABILITY

This invention pertains to retractable awnings, and more particularly to improvements which allow the awning to be set up and extended more conveniently.

Introduction

The effects of wind on prior retractable awnings, which are typically attached to the side of recreational vehicles, have caused damage to or destruction of such awnings. Wind gusts on the partially extended canopy of certain prior awnings can cause the awning to disassemble and collapse. Wind currents flowing over a retracted awning as the vehicle moves along a road have caused the canopy to unroll with consequential destruction or damage occurring thereafter.

To minimize the possibility of the canopy unrolling from its retracted position against the side of a moving vehicle, various "lift-to-lock" mechanisms have been devised. In general, the lift-to-lock mechanisms require the user to lift the weight of the awning at the side of the vehicle to disengage the roll bar from the lift-to-lock mechanism before the awning can be setup or extended. By latching or hooking the awning against the side of the vehicle, it is believed that unintentional unrolling of the awning would be prevented or inhibited since the wind force would be insufficient to lift the awning during vehicle movement. In actuality however, awnings have still occasionally unrolled from the side of a moving vehicle under the influences of environmental wind gusts and wind currents created by vehicle movement or when the moving vehicle jolted the awning upward. The practical effect of such lift-to-lock arrangements is that the amount of manual effort needed to release the awning and extend or set up the awning has been increased. Substantially the whole weight of the awning must be lifted at least a short distance in order to release the lift-to-lock mechanism.

In most prior awnings, the continual bias force of the power wind-up spring in the roll bar must be overcome in order to extend the canopy to its fully or partially unrolled or extended position. To maintain the roll bar against the force of the wind-up spring, awning braces are extended from the side of the vehicle and connected to the ends of the roll bar. Until the awning braces are connected, the roll bar must be manually restrained against the bias of the wind-up spring. Similar extension and restraint procedures must be followed with respect to each side of the awning. Although it is possible under proper procedural steps for one person to extend and set up a typical prior awning, it is inconvenient to do so. However, some people lack the strength and dexterity to set up the awning. Usually, two people are normally required to set up the awning.

In prior awnings, the bias force from the wind-up spring maintains the canopy taut and keeps the awning braces connected to the ends of the roll bar in a partially extended position. Should a sudden wind gust whip the canopy unexpectedly, the force of the wind-up spring can be momentarily overcome and the canopy will further unroll, causing the awning braces to disconnect from the ends of the roll bar. The awning thereafter collapses, usually with attendant damage or possible destruction or injury.

In order to adjust the height and degree of extension of the typical prior awning, the user must manually operate adjustment devices on the support arm and awning brace connected to the ends of the roll bar. Such adjustments are inconvenient and sometimes unyieldy because the force of the power roll-up spring must be overcome during such initial or subsequent adjustments.

The bottom ends of the support arms must be reliably connected to the side of the vehicle when the awning assembly is in its retracted position, but must be disconnectable when the awning is in use. One prior approach is to provide pins which must be removed from brackets attached to the side of the vehicle when the bottom ends are disconnected. Removable pins pose somewhat of a problem in that the pins may be lost or otherwise misplaced, preventing a reliable reattachment after use. A more significant problem is created in attempting to align the pin holes in the ends of the support arm and the bracket on the side wall when the awning is being collapsed or retracted. Aligning the holes and inserting the pin may be difficult, especially if some or all of the weight of the awning must be supported or the wind-up spring force must be restrained.

It is against this background of problems and inconveniences common to typical prior awnings that the improved features of the awning assembly of the present invention have resulted.

INVENTION SUMMARY

One of the improved features available from the present invention is in a roll control mechanism operatively connected between the roll bar and the support arm of the awning assembly for the purpose of locking selectively or restraining the roll bar from rotation in either direction when the awning assembly is in the retracted position or in any degree of extended position. By selectively locking the roll bar against unrolling movement when the awning assembly is in the retracted position, the canopy is restrained against unrolling under wind gusts and when the vehicle is moving. The typical lift-to-lock mechanism can be eliminated because of the locking or restraining action available from the roll control mechanism in the retracted position. The weight of the awning need not be lifted to move it to the extended position, and the awning assembly is easier to extend. When the canopy is in a partially extended position and locked against further unrolling, wind gusts are ineffective to overcome the bias force of the wind-up spring and unroll the awning sufficiently to disconnect the assembled awning brace members. The awning assembly is therefore less susceptible to damage or destruction by wind effects. To more easily extend or set up the awning assembly, the improved roll control mechanism is operatively controllable to allow unrolling movement of the canopy and to prevent rolling up movement. The support arms of the awning assembly are gripped and pivoted outward to extend the canopy. Once the support arms are pivoted out away from the vertical support surface to which the awning assembly is connected, the bias force of the power wind-up spring need not be further manually restrained because of the selective locking features of the roll bar. The awning support arms can be easily positioned and disconnected from the vertical support surface and the awning extension braces can be connected from the vertical support surface to the top ends of the support arm at the ends of the roll bar. A considerable reduction in manual effort is obtained as compared to the prior art awning where the support arms and roll bar must be manually held in the outer position while the awning extension braces are connected.

In accordance with the new and improved aspects of the roll control mechanism, a pair of clutch springs are operatively connected between the support arms and the roll bar. A first spring clutch has a plurality of coils which are wound in a direction to constrict around a sleeve member extension from the roll bar to restrain rotation of the roll bar in the first rotational direction while allowing rotation in the second rotational direction opposite to the first. The coils of the second spring clutch are wound around the sleeve member in the opposite direction to constrict around the sleeve member to restrain rotation in the second rotational direction while allowing rotation in the first rotational direction. The constriction of the first and second spring clutches is selectively controlled by a selector means to selectively allow the roll bar to be restrained from rotating in one rotational direction while allowing it to rotate to the other rotational direction, and vice versa. A handle of the selector means by which the operation of the spring clutches is controlled is preferably located on a support arm intermediate its ends for convenient manipulation and control by the user.

Another significant feature of the present invention is the ability to quickly and conveniently adjust the length of the support arm during the extension and setup of the awning assembly. In accordance with this aspect of the present invention, there is provided a handle assembly connected to the support arm which includes support locking means for selectively locking two support members of the support arm in a fixed length relationship. The two support members are preferably telescopingly connected together. Relative movement of the two support members adjusts the overall length of the support arm. The handle assembly includes the handle which is operatively connected for controlling the roll control mechanism, as has been described. Upon movement of the handle to control the roll control mechanism to allow the canopy of the awning to be unrolled from the roll bar, the support locking means operatively disconnects the two support members so that they may be telescopingly moved. Once the canopy has been unrolled to a desired position and the awning extension braces connected thereto, the support arm is lifted to its desired height to finalize the set-up of the awning assembly. The handle is moved back to the original position to prevent the canopy from unrolling. Simultaneously with moving the handle to the original position, the selective locking means operatively fixes the relative position of the two telescoping members. Manual adjustment of the support arm need not be accomplished as a separate step after the awning has been set up. The length adjustment of the telescopingly retained support members occurs quickly and conveniently and does not require separate manual effort on the part of the user.

Another significant feature of the present invention is an improved latching assembly for connecting the bottom end of the support arm to the side of the vehicle or other vertical support surface. In accordance with this aspect, the improved latching assembly comprises means for selectively pivotably connecting and latching the bottom end of the support arm thereto and for disconnecting the bottom end of the support arm by manual actuation. Preferably, the latching means includes a pivotably connected catch piece which can be quickly and conveniently moved to release the bottom end of the support arm. The catch piece also allows the bottom end of the support arm to be moved in contact with the catch piece and the catch piece automatically latches or grips the bottom end of the support arm, thereby making connection of the support arm bottom end with the latching means convenient. A shelf-like extension extends outward for the purpose of guiding the support arm bottom end into a latching relationship with the catch piece. A receptacle-like opening is defined for the purpose of receiving the outer end of the awning extension brace when the awning assembly is in the retracted position. With the outer end of the awning extension brace positioned in the receptacle, the catch piece is prevented from being pivoted into a position where the bottom end of the support arm would be released. The catch piece will not disconnect the bottom end of the support arm except when the user is setting up the awning assembly.

Another improved aspect of the present invention comprises a power wind-up spring within the roll bar which is formed from a length of sheet-like spring material coiled radially within the roll bar. The inner end of the power spring is connected to an axle shaft about which the roll bar rotates. The outer end of the spring is operatively connected to the roll bar. Overstressing the spring in the present invention is virtually impossible, unlike typical prior helically coiled and axially extending springs in awning roll bars. The radially coiled sheet-spring is less susceptible to the detrimental effects of rust and corrosion, as compared to prior helically coiled springs.

Other aspects, features and details of the present invention can be more completely understood by reference to the following detailed description of a preferred embodiment, taken in conjunction with the drawings, and from the appended claims.

DRAWING

FIG. 1 is a perspective view of the awning assembly of the present invention attached to a vertical support surface of a recreational or the like.

FIG. 2 is a perspective view of the awning assembly shown in FIG. 1 illustrated in its extended or unrolled position with a pair of support arms supporting the awning assembly from the ground or other horizontal surface.

Figure 4:
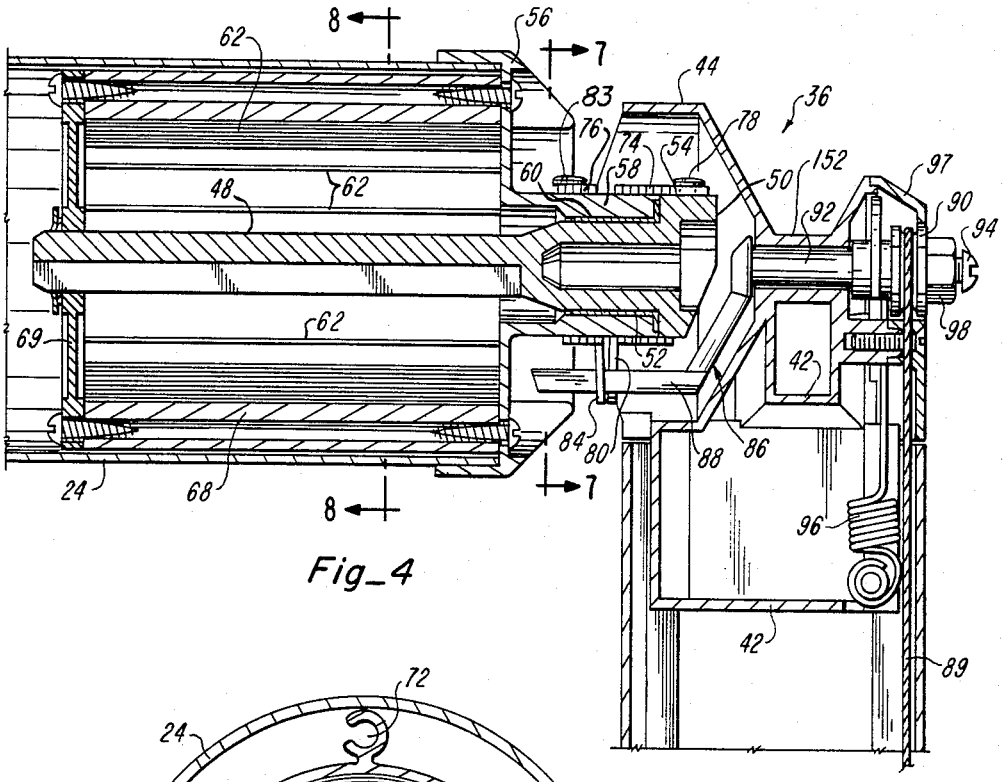
FIG. 4 is a section taken along line 4—4 of FIG. 3 with the axle shaft and its components of circular cross section shown in full.
Figure 7:
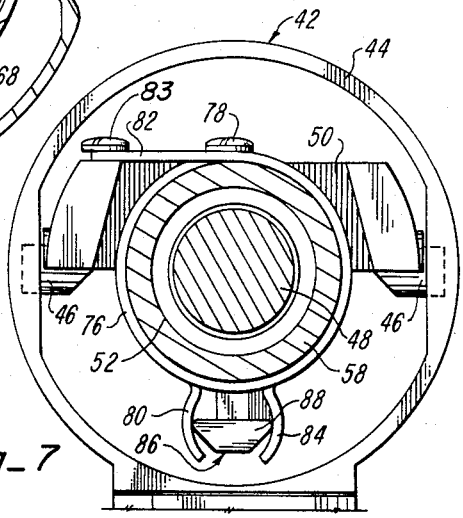
Figure 5:
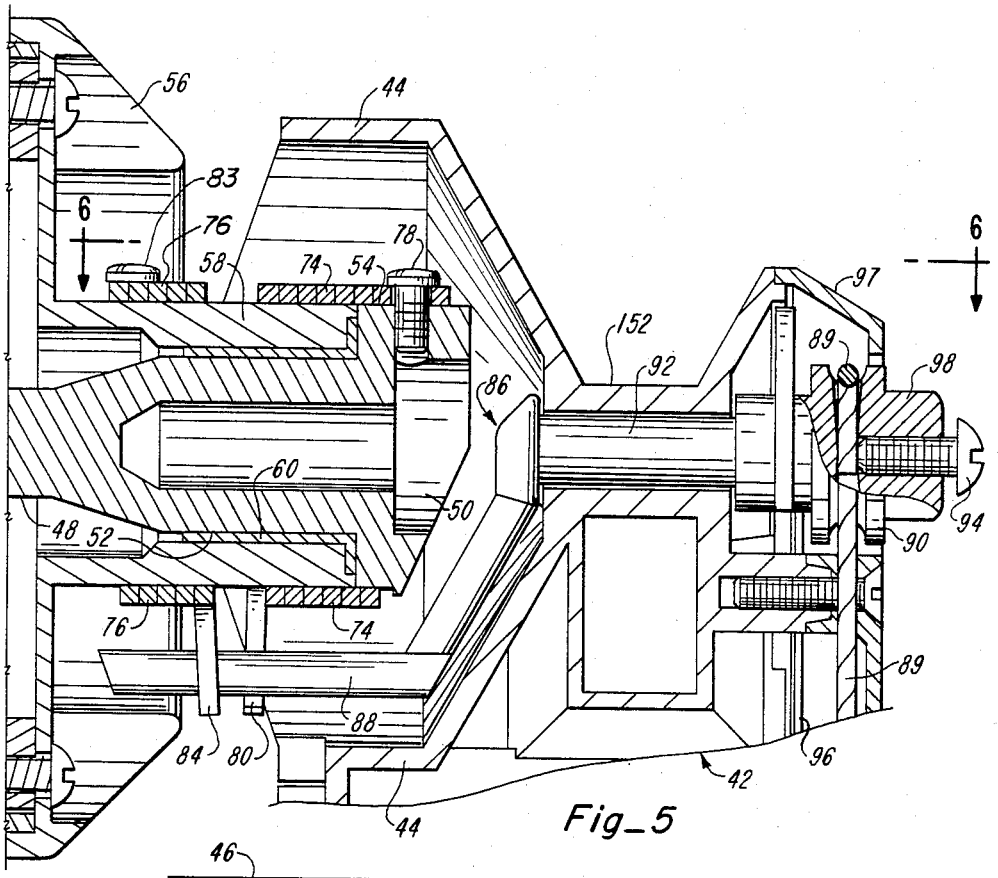
FIG. 5 is an enlarged fragmentary section similar to FIG. 4 with the axle shaft and its component parts of circular cross section shown sectioned.
Figure 6:
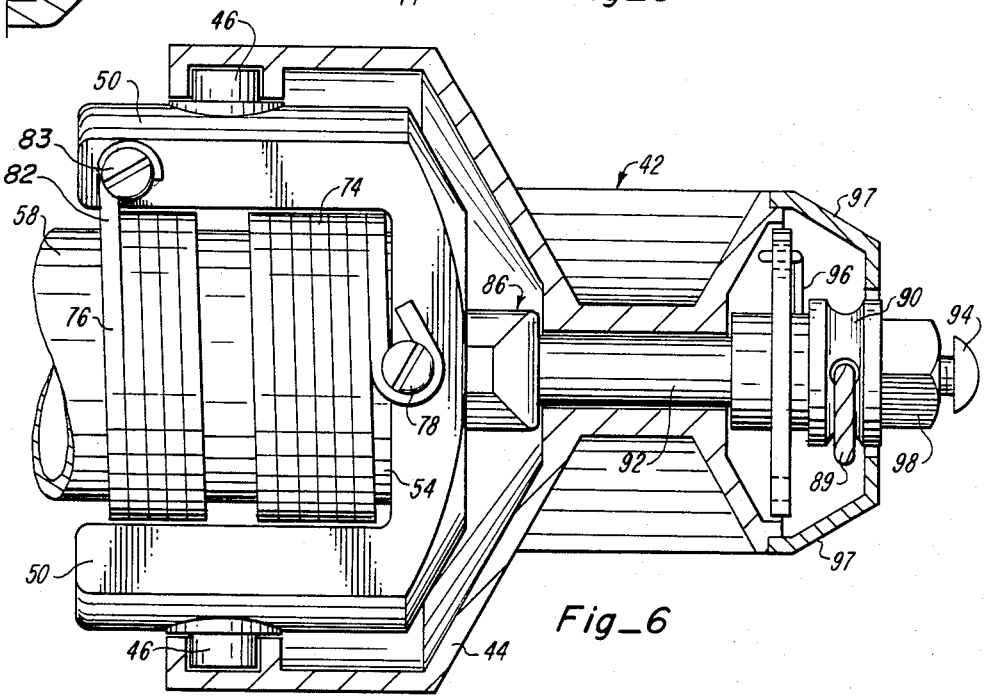
FIG. 6 is a top view of FIG. 5 with certain portions sectioned in the plane of line 6—6 of FIG. 5.

FIG. 7 a partial section view taken substantially in the plane of line 7—7 of FIG. 4.

Figure 8:
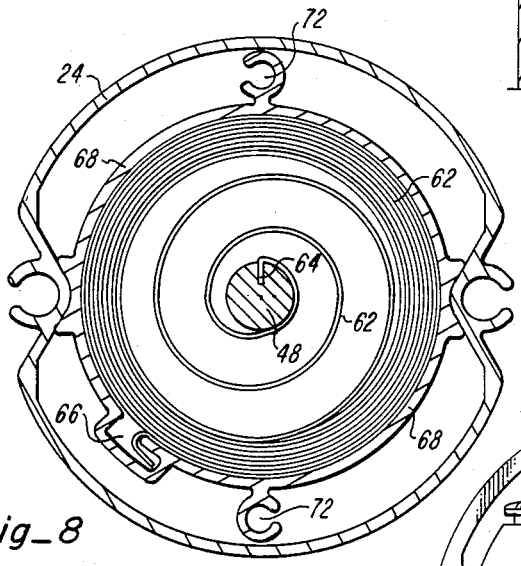

FIG. 8 is a section view taken substantially in the plane of line 8—8 of FIG. 4.

Figures 1, 2:
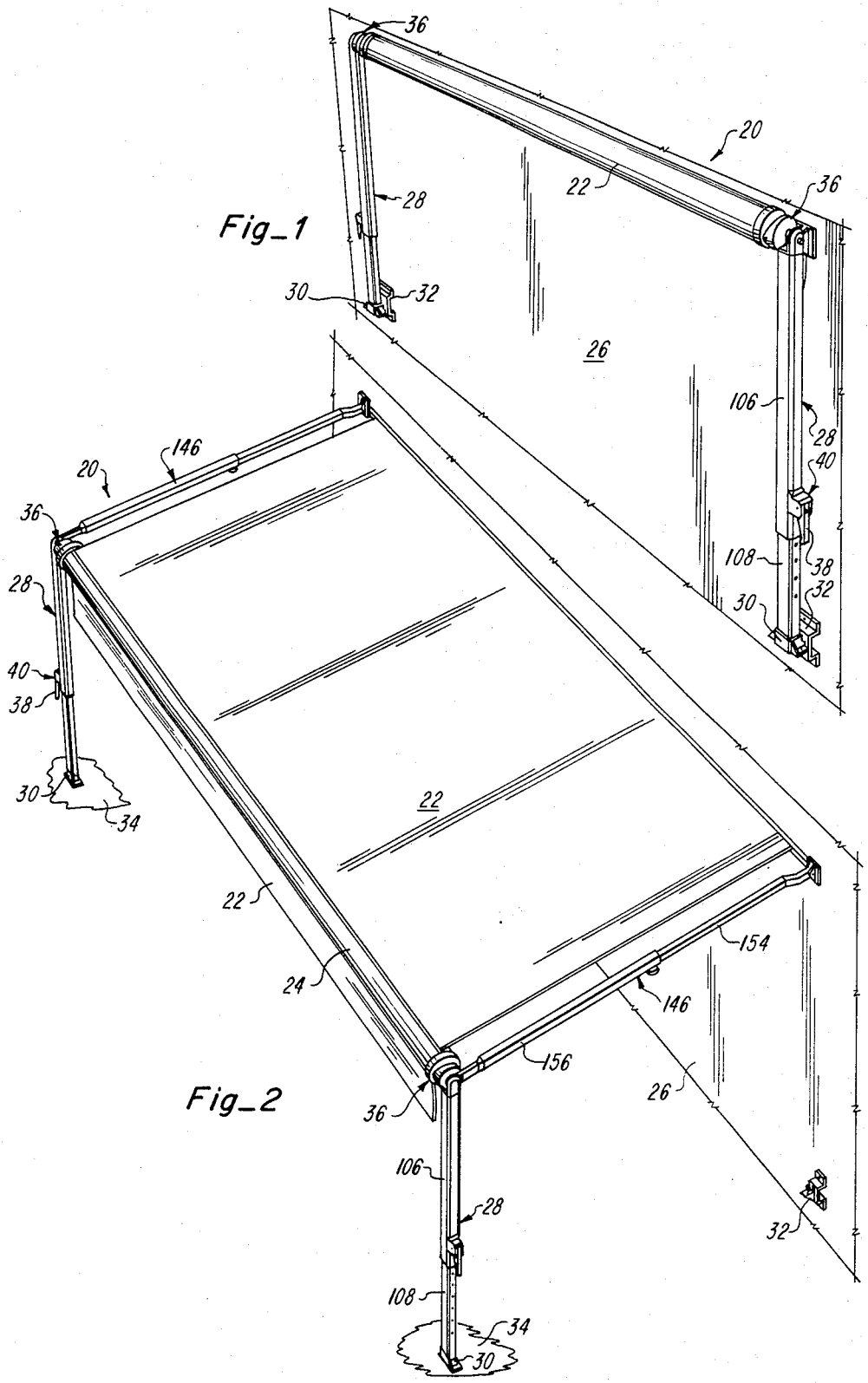
Figure 3:
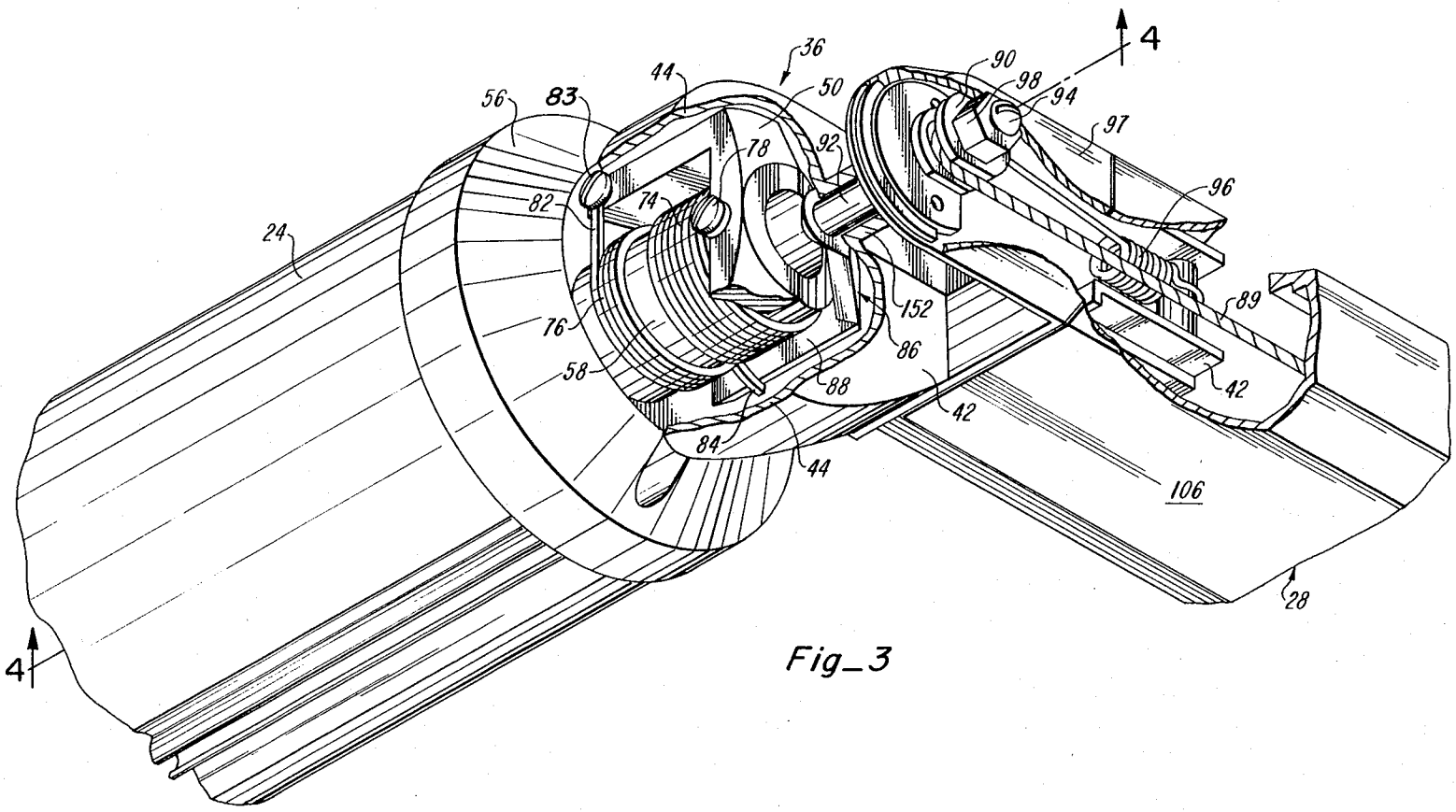
FIG. 3 is a perspective view with portions broken out illustrating the roll control mechanism and other associated elements at the junction between the roll bar end and the upper support arm of the awning assembly shown in FIG. 1.
Figure 9:
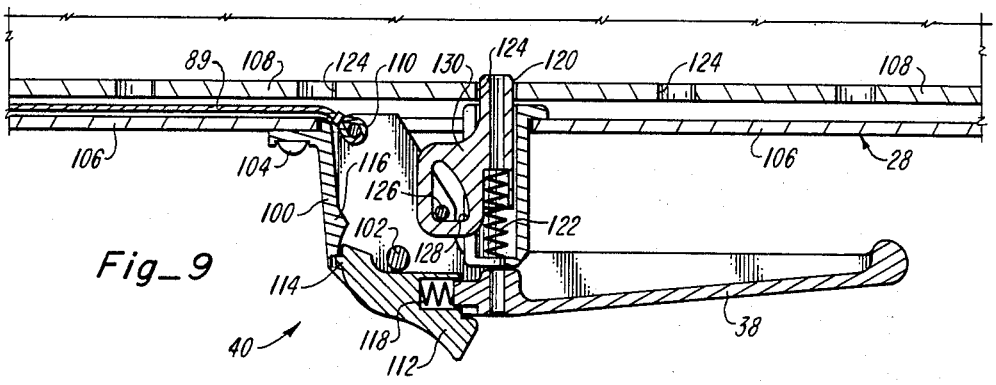

FIG. 9 is a section view taken through a handle assembly attached to a support arm taken in the plane of the support arm of the awning assembly shown in FIGS. 1 and 2.

Figure 10:
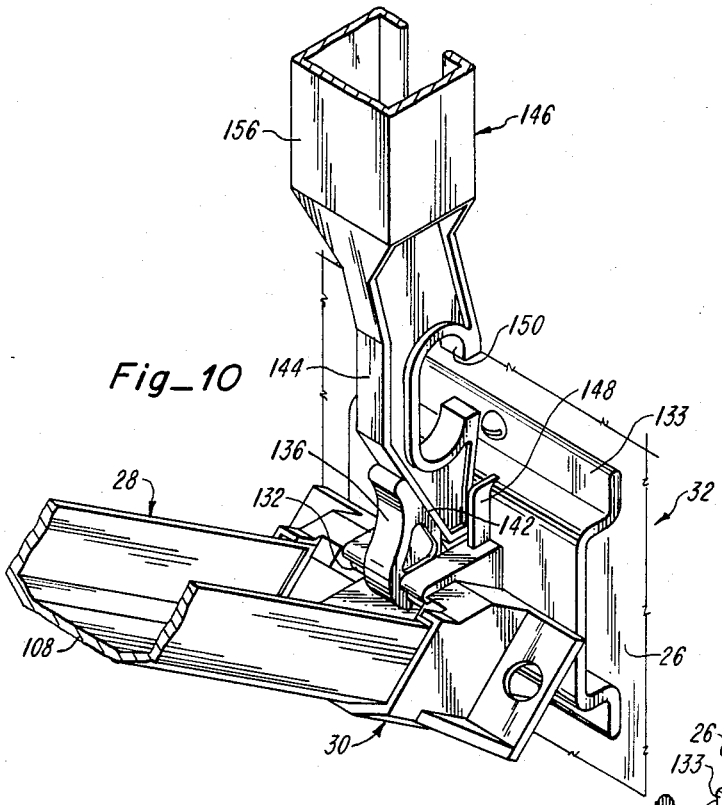

FIG. 10 is a perspective view of a latching assembly shown in FIGS. 1 and 2 attached to the vertical support surface and a foot attached at the bottom end of the support arm and pivotably connected to the latching assembly and an outer end of an awning brace member retained in a receptacle like space defined by the latching assembly.

Figure 11:
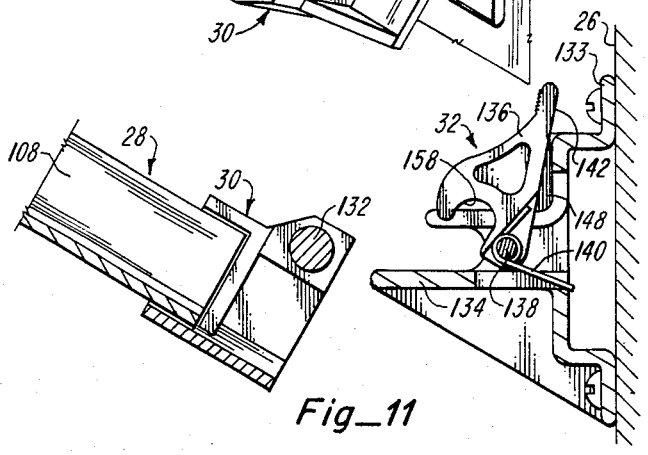

FIG. 11 is a partially sectioned side view of the latching assembly taken in the plane of the support arm and the awning brace shown in FIG. 10, with the support arm foot displaced laterally from the latching bracket assembly.

Figure 12:
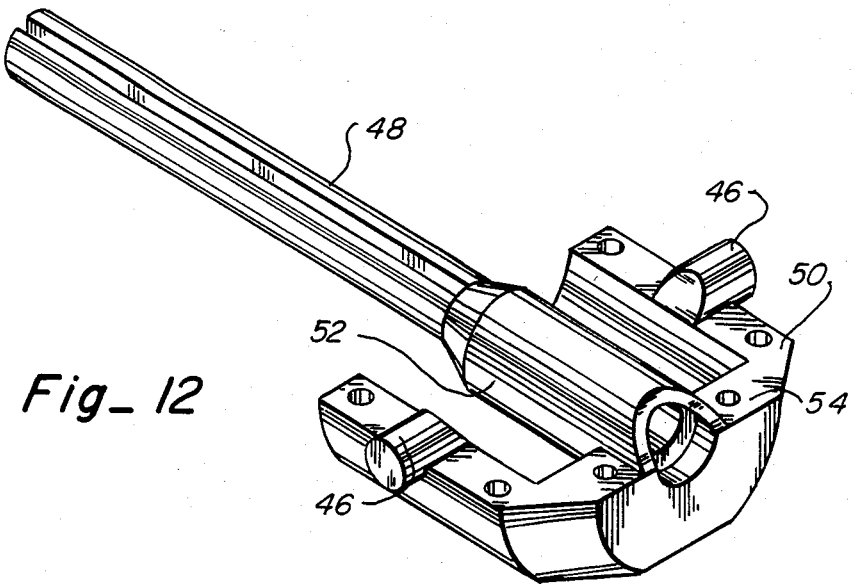

FIG. 12 is an isometric view of the axle shaft element of the retractable awning of the present invention.

Figure 13:
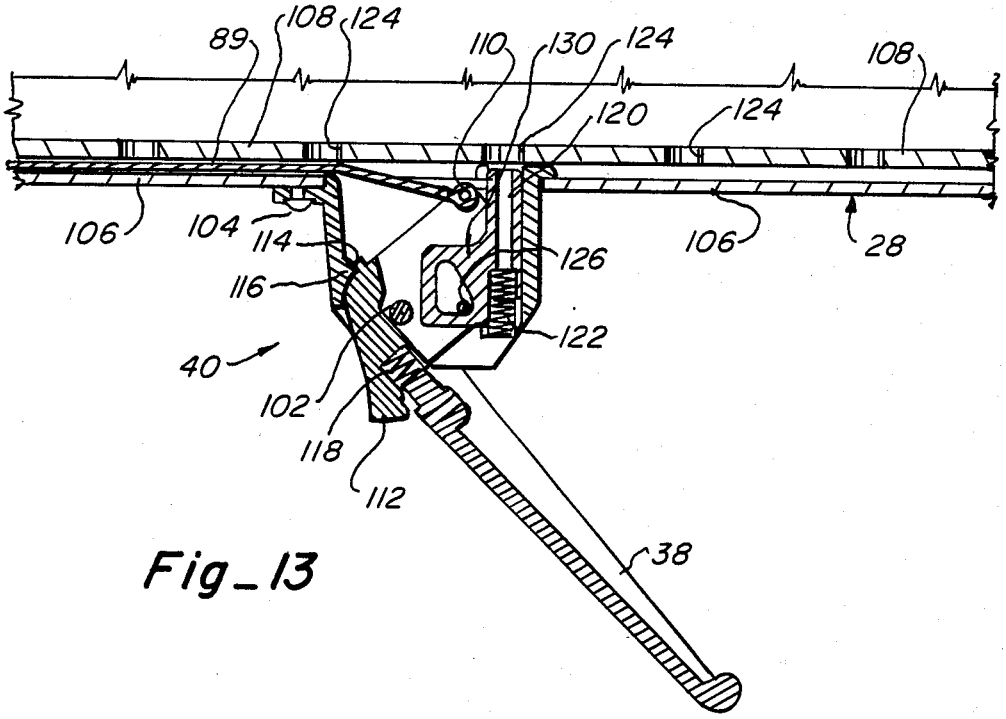

FIG. 13 is a section view similar to FIG. 9 showning the awning handle in its pivoted position.

DETAILED DESCRIPTION

The awning assembly of the present invention is referenced 20 in the drawings and is shown in FIGS. 1 and 2 as including a canopy 22 of generally rectangular configuration and a roller or roll bar 24 onto which the outer edge of the canopy 22 is secured. The awning assembly 20 is preferably attached to the side or vertical support surface 26 of a recreational vehicle or dwelling, for example. An inner edge of the canopy 22 is connected to the support surface 26. The top ends of a pair of support arms 28 are operatively connected at opposite axial ends of the roll bar 24 to allow the roll bar 24 to rotate relative to the support arms 28. The support arms 28 generally vertically support the roll bar 24 in both the retracted awning position shown in FIG. 1 and the extended awning position shown in FIG. 2.

A bottom foot 30 of each support arm 28 is selectively pivotably connected to or disconnected from a bottom latch assembly 32. The bottom latch assembly 32 is connected to the surface 26. In the retracted or rolled up position illustrated in FIG. 1, the foot 30 of each support arm 28 is connected to the latch assembly 32 and the support arms 28 extend generally parallel to the surface 26. Substantially all of the canopy 22 is rolled onto the roll bar 24. Substantially all of the weight of the awning assembly 20 is supported by the bottom latch assembly 32. In the extended position where the canopy 22 is unrolled from the roll bar 24 as shown in FIG. 2, the foot 30 of each support arm can remain connected to the latch assembly 32 with the support arm 28 pivoted away from the surface 26 (not shown), or the foot 30 of each support arm 28 can be disconnected and placed on a horizontal surface such as a ground surface 34 as shown in FIG. 2.

A roll control mechanism 36 is operatively connected between the top end of the support arm 28 and the axial end of the roll bar 24. The roll control mechanism 36 selectively operatively restrains or prevents the roll bar 24 from rolling to unroll the canopy from the retracted position shown in FIG. 1, even under the influence of winds and other forces. Accordingly, none of the typical prior art hooks, catches and the like which have required the user to lift the weight of the awning assembly upward in order to disconnect the awning from a holding mechanism is required. Instead, upon selective control of the roll control mechanism 36, as described hereinafter, the awning assembly 20 can be conveniently moved to its extended or unrolled position with substantially reduced effort. Once extended even partially, the roll control mechanism 36 restrains or prevents the roll bar from rotating to roll up the canopy. Once the awning assembly has been fully set up, the roll control mechanism can be controlled back to its first condition to prevent further unrolling of the canopy. The roll control mechanism 36 is effective at any particular degree of extension from fully extended to partially extended. In the typical prior awning, the power wind-up spring within the roll bar applies a continuous bias force attempting to roll up the canopy, and this continuous retraction force has sometimes created difficulties in manually restraining it while setting up the awning assembly. Furthermore, since the wind-up spring retraction force was required to hold most prior awnings in their extended position, wind could sometimes lift the canopy and disconnect the roll bar from the awning brace member and cause the undesired and unexpected roll up or destruction of the awning assembly. The roll control mechanism 36 of the present invention eliminates these undesirable characteristics typical of prior awnings and provides other improvements in awning assemblies.

Each roll control mechanism 36 is controlled by the movement of a handle 38 of a handle assembly 40. When the user moves the handle 38 to one pivoted position, the roll control mechanism 36 is operatively controlled to allow the roll bar 24 to rotate and extend the canopy 22 to an extended position. The roll control mechanism 36 prevents the roll bar 24 from rolling up the canopy and moving back to the retracted position. In order to retract the awning, the handle 38 is positioned in its other pivoted position and the roll bar rolls up the canopy 22 up until the awning reaches the retracted position. Once in the retracted position, the roll control mechanism prevents the roll bar from rotating to unroll the canopy.

Details of the roll control mechanism 36 are shown in FIGS. 3 to 7. A top housing member 42 is connected to the top end of the support arm 28. A cup-shaped portion 44 of the housing member 42 faces the end of the roll bar 24. At diametrically opposite points 46 on the edge of the cup-shaped portion 44, an axle shaft 48 is pivotally connected thereto by a yoke or cross end portion 50 of the shaft 48. The axle shaft 48 includes the U-shaped cross end portion 50 which is integral with the outer end of the axle shaft 48 and extends between pivot pins at the pivot points 46. The cup-shaped portion 44 defines a clevis at which the axle shaft is pivoted by the cross end portion 50 points 46. An outer enlarged portion 52 is formed near the outer end of the axle shaft 48. A cylindrical grip collar portion 54 of the axle shaft is located between the U-shaped portion 50 and the enlarged portion 52 of the shaft. An end cap 56 is attached to the end of the roll bar 24. The end cap 56 includes an outward projecting cylindrical sleeve member 58 which extends outward concentrically about the enlarged portion 52 and terminates adjoining to the grip collar portion 54. The outer diameters of the grip collar 54 and the sleeve member 58 are the same. A bushing 60 is located intermediate the sleeve member 58 and the outer surface of the enlarged portion 52.

By pivoting the shaft 48 at the points 46, the roll bar 24 and support arm 28 are free to pivot through a limited angle on each side of the perpendicular relationship which the roll bar 24 and support arm 28 normally occupy. Pivoting in this manner allows the user to adjust one side of the awning assembly 20 (FIGS. 1 and 2) outward at a different angle than the other side is adjusted during the extension of the awning assembly 20.

A power wind-up spring 62 for the roll bar 24 is formed from a rectangular piece of sheet spring material, as shown in FIGS. 4 and 8. One longitudinal end of the spring 62 is connected in a slot 64 in the axle shaft 48. The other end of the spring 62 is retained within a holding notch 66 in the hollow interior of a torque tube 68. The torque tube 68 received within the hollow end of the roll bar 24 and is rigidly retained for movement in unison with roll bar 24, as shown in FIG. 8. An end cap piece 69 is connected to the torque tube 68 by screws shown in FIG. 4. The end cap piece 69 includes a bearing which rotationally supports the inner end of the shaft 48. The end cap 56 is connected to the roll bar 24 by screws. Other screws (FIG. 4) extend from the end cap 56 into cylindrical openings 72 in the torque tube 68 to further retain the torque tube for movement in unison with the roll bar 24. The power spring 62 provides continuous bias on the roll bar 24 tending to roll the canopy 22 onto the roll bar. The power spring 62 is initially biased by coiling the spring to provide roll-up bias even when the canopy is in the retracted position. Of course, when the canopy is in the extended position, the power spring is even further coiled and provides a greater amount of roll-up force. The axle shaft 48 does not rotate relative to the support arm 28 because of its trunnion-like connection to the housing member 42 connected to the support arm 28.

The wind-up power spring 62 offers substantial advantages over the helically coiled wire spring employed in typical prior awnings. When the sheet spring 62 is fully wound, it simply will not elongate further. Overstressing to cause yield is therefore impossible, unlike a coiled wire spring. The spring 62 is more immune to rust because grease is confined around the spring 62 by the torque tube 68 and end cap piece 69, unlike prior coiled wire springs where sizable amounts of grease are distributed within a large area inside the roll bar. Enclosing the spring 62 within the torque tube makes assembly of the spring into the roll bar more convenient, by simply inserting the torque tube and attaching the end cap 56. Handling of the spring 62 during awning assembly is also simplified because of the compact enclosure within the torque tube.

In order to selectively lock or restrain the roll bar 24 against rotation, springs 74 and 76 are provided in each roll control mechanism. The spring 74 and 76 are of typical spring clutch type which grip the member around which the coils are wound when the springs constrict in the direction in which they are coiled, and release the grip on the member around which the coils are wound when the coils are slightly moved or unwound in the opposite direction of the coiling direction. The outer spring 74 is wound with at least one coil around the grip collar portion 54 of the axle shaft 48 and with the remaining coils wound around the outer portion of the sleeve member 58 of the end cap 56. One end of the spring 74 is rigidly retained to the U-shaped portion 50 of the axle shaft 48 by a screw 78. The other or tang end 80 of the spring 74 extends freely from the last coil on the other end of the spring 74 downward below the sleeve member 58. The inner spring 76 is wound only around the sleeve member 58 at a location inwardly spaced from the outer spring 74. One end 82 of the inner spring 76 is contacted by and retained to U-shaped portion 50 by a screw 83. The other or tang end 84 of the inner spring 76 extends freely from the last coil of the other end of the spring 76 downward below the sleeve member 58.

The springs 74 and 76 are coiled in respectively opposite directions on the sleeve member 58 from their retained ends to their tang ends. Because of the operative spring clutch nature of the springs 74 and 76, attempted rotation of the roll bar 24 in one rotational direction will cause one of the springs 74 or 76 to more firmly constrict around the sleeve member 58 and lock or prevent rotation of the roll bar in the attempted direction. Similarly, attempted rotation in the other rotational direction will cause the other spring 74 and 76 to more firmly constrict around the sleeve portion and lock or prevent rotation of the roll bar in the other attempted direction. The grip collar 54 of the shaft 48 provides a large surface for gripping by the outer spring 74 to distribute the retention force over a large area of the shaft 48.

In order to control the clutch-like locking capability of the springs 74 and 76, selector means is provided. The selector means includes a selector lever 86 which is pivotally retained within the top housing member 42. An actuator arm 88 of the lever 86 extends between the tang ends 80 and 84, of the springs 74 and 76, respectively. Upon pivoting the selector lever 86, the actuator arm 88 contacts one of the tang ends and moves it in a direction which slightly uncoils or unwinds the spring to which the tang end is connected. The actuator arm moves out of contact with the tang end of the other spring. The slightly unwound spring 74 loses its ability to constrict and thereby lock or restrain the sleeve member 58 in either rotational direction of the sleeve member. The other spring is free to constrict about the sleeve member and restrain rotation in one direction, but inherently lacks the ability to prevent rotation of the sleeve member in the other direction. The roll bar is restrained against rotation in one direction when the selector lever 86 is pivoted in the other direction, the opposite effect on the springs results and the roll bar is prevented from rotating in the other direction. For a first example, assume that the tang end 80 has been contacted by the actuator arm 88 and moved to slightly uncoil the outer spring 74. In this condition, the one spring, e.g. 74, has been uncoiled and therefore lacks the ability to restrain against rotation in either the first or second rotational directions. The other spring, e.g. 76, because of its coil winding direction, inherently is unable to restrain rotation in one direction, e.g. the first rotational direction. However, since the actuator arm 88 is out of contact with the other tang end, e.g. 84, the other spring, e.g. 76, is allowed to constrict tightly around the sleeve member 58 and prevent rotation in the other direction, e.g. the second rotational direction, when rotation is attempted. Upon movement of the selector lever in the other pivoted direction, i.e., the actuator arm moves into contact with tang end 84 and out of contact with tang end 80, the opposite effect from that described in the above example is created, and the roll bar is prevented from rotating in the opposite first rotational direction.

To control the pivotable movement of the selector lever 86, the handle 38 of the handle assembly 40 is connected by a cable 89 to a pulley 90 formed at the outer end of a shaft 92 of the selector lever 86, as is shown in FIGS. 3, 4, 5 and 9. The cable 89 extends over the pulley 90 and is held in position by a set screw 94. A spring 96 biases the selector lever 86 in one pivotable direction and pulling force from the cable 89 rotates the selector lever in the opposite direction. The cable 89 is pulled when the handle 38 is pivoted away from a position parallel to the support arm 28, as will be described in greater detail below. A cap 97 is attached to the housing member to cover the cable 89 and portions of the pulley 90 and spring 96.

The pivoted location of the selector lever 86 is initially adjusted to contact the actuator arm 88 with one of the spring end tangs 80 or 84 and slightly uncoil the appropriate spring to allow rotation of the roll bar 24 in the direction for rolling up the canopy 22 and to prevent unrolling of the canopy 22. The handle 38 of the handle assembly 40 in this position is located parallel to the support arm 28. Should the cable 89 break or become disconnected, the spring 96 biases the selector lever to pivot and contact the appropriate spring clutch to allow the canopy to be rolled up. However, a nut-like protuberance 98 is provided on the outer end of the selector lever 86 at a location outboard of the cap 97, to allow a wrench to be placed over the protuberance 98 for the purpose of manually pivoting the selector lever to control the spring clutches 74 and 76 in emergencies.

The positive locking effect available from the spring clutches is a significant advantage since one cause of awning destruction is unexpected unrolling while moving down the highway, as might occur if a previous awning is jolted off of its "lift-to-lock" hooking mechanism. Similarly, the canopy 22 can be prevented from further unrolling in strong winds after the awning has been set up in its extended position. In typical prior awnings where the force from the wind-up spring was relied on to hold the canopy taut in a partial extended position, strong wind gusts have been known to overcome the bias force from the wind-up spring, unroll the canopy and allow the various elements of the awning to disconnect from one another, resulting in collapse or damage under such circumstances.

To extend the awning to an in-use position, the user need only lift the handle 38 of the handle assembly 40 to allow unrolling and outward movement of the roll bar. So long as the handle of the handle assembly is in the lifted or pivoted position, the canopy will not roll up and the roll bar will remain at the position to which it has been extended, without returning to the retracted position. The user can quickly and easily adjust the awning assembly to a desired extended position without continually having to restrain the awning against the wind-up force from the power spring. One person can conveniently and without great effort set up the awning assembly 20 of the present invention without help, a task which was very difficult, if not impossible, with typical prior awnings.

Another significant improvement available from the spring clutch type of roll control mechanism is that one of the spring clutches is always effective at all times to restrain rotation in at least one direction. It is impossible to create a situation where both clutch like locking mechanisms are ineffective. Even when the actuator arm of the selector lever is midway between both spring tang ends, both spring clutches are effective to substantially inhibit rotation. Furthermore, because independently controllable spring clutch roll control mechanisms 36 are provided at both ends of the roll bar 24 (FIGS. 1 and 2), each can be operated to an opposite operative condition to prevent rotation of the roll bar in either direction. The handle assemblies 40 which control the operative condition of each spring clutch roll control means are located within convenient reach of the user when the awning assembly is being extended or retracted.

The handle assembly 40 is shown in detail in FIG. 9. The handle 38 is pivotally connected to a housing 100 by a pivot pin 102. The housing 100 is connected by rivets 104 to an outer U-shaped channel member 106 of the support arm 28. An inner channel member 108 of the support arm 28 telescopes within the outer channel member 106. The channel openings of both members 106 and 108 preferably face to the rear toward the vertical surface 26 (FIG. 1). The end of the cable 89 is connected to an anchor pin 110 of the handle 38. Upon pivoting movement of the handle in a clockwise direction, as shown in FIG. 9, the cable 89 is pulled from the left to the right. The cable 89 rotates the pulley 90 and the selector lever 86 (FIG. 3), as has previously been described. A thumb operated handle locking means or lock 112 includes a lip 114 which interacts with a protrusion 116 of the housing 100. The thumb lock 112 is normally biased to the left, as shown in FIG. 9, by a spring 118. The handle 38 is held in the down position parallel to the support arm 28 when the lip 114 is biased outward against the bottom edge (as shown in FIG. 9) of the protrusion 116. In order to move the handle to its pivoted position, the user pulls the thumb lock 112 backward (to the right as shown in FIG. 9) and pivots the handle 38 clockwise, as shown in FIG. 9. Once the handle has been pivoted sufficiently, the thumb lock 112 is released and the lip 114 is free to move to the top edge (as shown in FIG. 9) of the protrusion 116, thereby holding the handle 38 in the pivoted position. In this manner, the operation of the roll control mechanism is selected and maintained in a desired operative condition.

Means for selectively adjusting and locking the length of the support arms 28 is also incorporated within the handle assembly 40. A locking pin 120 is retained for vertical (as shown in FIG. 9) movement within the housing 100. A spring 122 biases the locking pin 120 to an extended position (upward as shown). The end of the locking pin extends into one of a plurality of locking structure openings 124 formed at intervals along a segment of the inner channel member 108. A pulling pin 126 extends from the handle 38 within an opening 128 of an extension 130 of the locking pin 120.

When the handle 38 is moved to its pivoted position during extension and setup of the awning assembly, the pulling pin 126 moves the locking pin 120 and retracts the locking pin by moving it vertically downward (as shown in FIG. 13). The end of the locking pin 120 is withdrawn from within one of the locking openings 124. The inner channel member 108 is thereby allowed to telescope with respect to the outer channel member 106.

When the roll control mechanism is controlled to allow the awning to be unrolled or extended, the connection of the inner channel member 108 is also released so the user can adjust the length of the support arm 28. Upon reaching approximately the desired length, the handle 38 is moved back to its unpivoted position. Should the end of the locking pin 120 not immediately align with one of the locking holes 124, the locking pin will be forced against the inner channel member 108 by the spring 122. The user need only move the outer channel members 106 a small amount before the locking pin 120 aligns with and is forced into one of the holes 124. The length of the support arm 28 is quickly and rapidly adjusted without necessity for further actions by the user except to allow the inner and outer channel members of the support arm 28 to move slightly until a locking relationship is established. This is an improvement over typical prior awnings where various adjusting screws or the like had to be manipulated while lifting the outer channel member in order to obtain a desired length of the support arm.

Normally when setting up or extending the awning, as shown in FIG. 2, the handles will be pivoted to allow the canopy to be unrolled and to prevent it from being rolled up. Once the canopy is unrolled to its desired extent, it will stay there. Thereafter, the user adjusts the length of and attaches the awning brace members (referenced 147 in FIG. 2 and described in detail subsequently) to the ends of the support arms and roll bar. The brace members 146 prevent the canopy from rolling up once the handles are moved back to the unpivoted position. However, before moving the handles back to the unpivoted position, the outer channel member is lifted with respect to the inner channel member to position the end of the roll bar at the desired heights. The handle is moved to its unpivoted position once the desired height is reached to simultaneously lock the roll bar from further unrolling and lock the length of the support arm.

Details of the improved latch assembly 32 for operatively pivotably connecting and disconnecting the foot 30 of the support arm 28 to the vertical surface 26 are shown in FIGS. 10 and 11. The foot 30 is connected to the inner channel member 108. The foot 30 includes a bar 132 extending transversely across the open channel at the end of the inner channel member 108. A latch bracket 133 of the latch assembly 32 is connected to the vertical surface 26 by screws or the like. The latch bracket 133 includes a lower horizontal shelf-like extension 134 and a catch piece 136 pivotally connected by a pin 138 above the shelf extension 134. A spring 140 normally biases the catch 136 counterclockwise as shown in FIG. 11. A rearward facing flat surface 142 of the catch piece 136 extends at an acute angle with respect to the vertical surface 26 when the catch piece 136 is biased in its downward position (counterclockwise as shown in FIG. 11).

An outer end 144 of an awning extension brace 146 is adapted to fit within the receptacle-like space defined behind the surface 142 and in front of the latching bracket 133 when the awning assembly is in the retracted position. A pair of laterally spaced protrusions 148 extend from the brackets 133 on opposite sides of the brace end 144 to prevent the end 144 from moving away from the catch piece 136 and out of the receptacle-like space. The other end of the awning brace 146 is pivotally connected to the vertical surface 26 at approximately the position where the inner edge of the canopy 22 attaches to the vertical surface (FIG. 2). When in the extended position (FIG. 2), an opening 150 within the brace end 144 fits over and connects with a center cylindrical sleeve portion 152 (FIGS. 3 to 5) of the housing member 42. In this manner, the brace member 146 operatively prevents the roll bar 24 from rolling up from its extended position and allows the support arm 28 to extend to the ground surface 34 or to the vertical surface 26.

The awning brace 146 comprises two brace members 154 and 156 which telescope with respect to one another, and the length of which can be adjusted in accordance with the degree of extension desired for the awning assembly, as shown in FIG. 2. When the awning assembly 20 is in the retracted position (FIG. 1), the awning brace 146 fits within the channels of the channel members 106 and 108 of the support arm 28.

A hook-shaped portion 158 of the catch piece 136 is adapted to connect around the bar 132 of the foot 30. To aid in guiding the bar 132 to the hook-shaped portion 158, the bar 132 is first be supported on the shelf extension 134. Thereafter, the support arm 28 is moved to push the bar 132 against the catch piece 136. The bar 132 forces the catch 136 clockwise (as shown in FIG. 11) until the bar moves within the hook portion 158. The spring 144 moves the catch piece 136 counterclockwise, as shown in FIG. 11, and the foot 30 of the support arm 28 is firmly connected. The shelf extension 134 extends into the open channel of the channel member 108 to avoid interference as the bar 132 moves toward the catch piece 136. In order to release the bar from the catch piece 136, the outer end of the catch piece is manually moved clockwise, as shown in FIG. 11. The shelf extension 134 allows the user to conveniently support the bar 132 of the foot 30 on the latching bracket 32 and guide the support arm to align the bar 32 with the catch piece 136 for convenient latching movement. Once the foot 30 is connected to the latching bracket 32 and the brace end 144 is placed behind the catch piece 136, as shown in FIG. 10, the catch piece 136 cannot be pivoted to release the foot 30 from the latching assembly 32. This arrangement assures that the foot end of the support arm 128 will not become disconnected from the vertical surface 26 as the vehicle to which the awning assembly is attached moves along the highway, for example, or until the user is ready to extend the awning assembly.

The nature, improvements and operation of the present invention have been shown and described with a degree of particularity, and the advantages of the present invention have been described briefly. It should be understood, however, that the specificity of the description has been made by way of preferred example and that the invention is defined by the scope of the appended claims.

What is claimed is:

1. In a retractable awning assembly having a roll bar upon which a canopy is rolled, a wind-up power spring for rotationally biasing the roll bar for rolling the canopy thereon, a support arm having one end operatively connected to one end of the roll bar and another end for contacting a support surface, and a roll control mechanism in combination therewith including improvements comprising:

a sleeve member operatively connected to rotate with the roll bar;

a first spring clutch having an end operatively restrained by said support arm and having a plurality of coils wound around the sleeve member in a direction for constricting around said sleeve member to restrain rotation of the roll bar in a first rotational direction and for allowing rotation in a second rotational direction opposite to the first direction;

a second spring clutch having an end operatively restrained by said support arm and having a plurality of coils wound around the sleeve member in a direction for constricting around said sleeve member to restrain rotation of said roll bar in the second rotational direction and for allowing rotation in the first rotational direction; and selector means operatively connected to said first and second spring clutches for selectively controlling the constriction of each of said first and second spring clutches around the sleeve member to control the direction of rotation of the roll bar, said selector means operatively allowing constriction of said first spring clutch and simultaneously inhibiting constriction of said second spring clutch to allow the roll bar to rotate in the second rotational direction and restrain rotation of the roll bar in the first rotational direction and selectively alternatively allowing constriction of said second spring clutch and simultaneously inhibiting constriction of said first spring clutch to allow the roll bar to rotate in the first rotational direction and restrain rotation of the roll bar in the second rotational direction.

2. An invention as defined in claim 1 wherein:

each spring clutch also has a tang end which extends freely from a coil of said spring clutch, the tang end being the opposite end of said spring clutch from the end operatively restrained by said support arm; and said selector means comprises an actuator member operatively connected to the support arm for movement into first and second positions, and wherein in the first position the actuator member contacts and moves the tang end of the first spring clutch to rotate the coils of the first spring clutch a predetermined amount in the direction opposite to that which the coils are wound on the sleeve member to inhibit constricting of the coils of the first spring clutch around the sleeve member, and wherein in the second position the actuator member contacts and moves the tang end of the second spring clutch to rotate the coils of the second spring clutch a predetermined amount in the direction opposite to that which the coils of the second spring clutch are wound around the sleeve member and to inhibit constricting of the coils of the second spring clutch around the sleeve member.

3. An invention as defined in claim 2 wherein:

when the actuator member is in the first position, the tang end of the second spring clutch is not contacted by said selector lever and the coils of the second spring clutch can constrict around the sleeve member to restrain rotation in the second rotational direction; and when the actuator member is in the second position, the tang end of the first spring clutch is not contacted by said selector lever and the coils of the first spring clutch can constrict around the sleeve member to restrain rotation in the first rotational direction.

4. An invention as defined in claim 3 wherein said selector means further comprises means for selectively moving the actuator member to the first and second positions and for maintaining the actuator member in the position to which it is moved.

5. An invention as defined in claim 2 wherein said selector means further includes:

a handle assembly connected to the support arm at a position intermediate the ends of the support arm, the handle assembly including a handle movable into first and second operative positions; and means interconnecting the handle and the actuator member for moving the actuator member into the first and second positions upon movement of the handle into the first and second positions, respectively.

6. An invention as defined in claim 5 wherein:

said support arm comprises first and second support members telescopingly connected together, the first support member operatively connected at one end to the end of the roll bar, the handle assembly connected at the other end of the first support member, the second support member includes a plurality of holes formed therein at intervals along a segment of its length; and said handle assembly further comprises a locking pin adapted to extend from the handle assembly into a selected one of the holes in the second support member to lock the second support member in a fixed position with respect to the first support member, the locking pin operatively connected to said handle to be retracted from within the hole in the second support member upon movement of said handle to one operative position from the other operative position.

7. An invention as defined in claim 6 wherein:

said handle assembly further comprises means biasing the locking pin toward the extended position; and the locking pin is connected to said handle by connection means which allows said locking pin biasing means to extend said locking pin upon movement of said handle from the other operative position to the one operative position.

8. An invention as defined in claim 5 wherein:

said support arm comprises first and second support members operably connected together to selectively vary the length of said support arm between its opposite ends upon relative movement of said support members;

said handle assembly is connected to one of said support members;

said handle assembly further includes selective support locking means for selectively locking the first and second support members in a fixed position relationship with one another to fix the length of the support arm; and said selective support locking means being operative upon movement of said handle into one operative position to lock the support members in the fixed position relationship and being operative upon movement of said handle into the other operative position to release the fixed position relationship of the support members and allow the support members to move relative to one another.

9. An invention as defined in claim 8 wherein said handle assembly includes handle locking means for selectively locking the handle in the first and second positions.

10. An invention as defined in claim 8 wherein:

the first and second support member are telescopingly connected together;

the first support member is operably connected at one end to the end of the roll bar and said handle assembly is connected at the other end;

the second support member extends from the other end of the first support member to a bottom end adapted for contact with the support surface; and further comprising:

a foot device attached to the bottom end of the second support member; and latching means adapted to be connected to a vertical surface and operable for selectively connecting and latching the foot device thereto upon movement of the foot device against said latching means and for disconnecting the foot device by manual actuation of said latching means.

11. An invention as defined in claim 10 wherein:

said latching means includes a shelf extension extending outward from the vertical surface for supporting and guiding the foot device into a latching relationship with said latching means.

12. An invention as defined in claim 11 wherein:

said foot device includes a bar extending generally laterally of the second support member;

said latching means comprises a pivotable catch piece adapted to receive and hold the bar of said foot device and to release the bar of said foot device when said catch piece is pivoted; and said awning assembly further includes an awning brace member having an end adapted to operatively connect to the end of the support arm operatively connected to the end of the roll bar, the end of the brace member also adapted to contact the catch piece of said latching means when said brace member is not connected to the support arm, the end of the brace member having a configuration to prevent the catch piece from pivoting when the brace member end is in contact with the catch piece.

13. An invention as defined in claim 1 wherein the wind-up spring comprises a spring coiled about the rotational axis of the roll bar from an inner radial position to an outer radial position.

14. An invention as defined in claim 13 wherein the wind-up spring is retained within a torque tube and the torque tube is connected to the roll bar.

15. In a retractable awning assembly having a roll bar upon which a canopy is rolled, a wind-up power spring for rotationally biasing the roll bar for rolling the canopy thereon, one support arm for operatively supporting one end of the roll bar from a support surface, clutch means operatively connected between the roll bar and the end of the support arm and having a first selective operating condition for inhibiting roll bar rotation in a first rotational direction and allowing roll bar rotation in a second rotational direction opposite to the first rotational direction and having a second selective operating condition for inhibiting roll bar rotation in the second rotational direction and allowing roll bar rotation in the first rotational direction, and an improvement in combination therewith comprising:

selector means operatively connected for controlling said clutch means to operate in a selected one of the first or second operating conditions, said selector means including an operating device connected to the support arm at a position intermediate the ends of the support arm and adapted to be manually moved to first and second operative positions at which said selector means controls said clutch means to operate in the first and second operating conditions, respectively.

16. An invention as defined in claim 15 wherein said operating device of said selector means comprises:

a handle assembly comprising a handle selectively movable into the first and second operative positions and handle locking means for locking said handle in the selected one of the first and second operative positions.

17. An invention as defined in claim 15 wherein:

said operating device of said selector means comprises a handle assembly comprising a handle selectively movable into the first and second operative positions; and said selector means comprises a selector device movably connected at the end of the support arm and operatively connected to said clutch means for controlling said clutch means into the first or second operating conditions upon movement of said selector device, and means extending along a segment of length of the support arm and operatively connecting the handle and the selector device to move the selector device upon movement of the handle.

18. An invention as defined in claim 17 wherein:

said support arm comprises first and second support members operably connected together to selectively vary the length of said support arm between its opposite ends upon relative movement of said support members;

said handle assembly is connected to one of said support members;

said handle assembly further includes selective support locking means for selectively locking the first and second support members in a fixed position relationship with one another and to fix the length of the support arm; and said support locking means being operative upon movement of said handle into one operative position to lock the support members in the fixed position relationship and being operative upon movement of said handle into the other operative position to release the fixed position relationship of the support members and allow the support members to move relative to one another.

19. An invention as defined in claim 18 wherein:

the first support member is operatively connected at one end thereof to the end of the roll bar;

said handle assembly is operatively connected at the other end of said first support member;

the second support member includes a plurality of locking structures positioned at intervals along a segment of the length of the second support member; and said support locking means comprises a locking device biased to extend into engagement with one of said locking structures to fix the second support member in a selected position with respect to the first support member, the locking device being operatively connected to said handle to be retracted from engagement with the one of the locking structures upon movement of said handle to one operative position from another operative position.

20. An invention as defined in claim 15 wherein:

said awning assembly includes two support arms, one support arm operatively connected to each end of the roll bar; and one said clutch means and one said selector means are operatively associated with each support arm.

21. In a retractable awning assembly having a roll bar upon which a canopy is rolled, a wind-up power spring for rotationally biasing the roll bar for rolling the canopy thereon, a support arm having a top end operatively connected to one end of the roll bar and a bottom end for contacting a support surface, and a roll control mechanism in combination therewith including improvements comprising:

an end cap connected to one end of the roll bar and including a cylindrical sleeve member extending outward from the end cap coaxially about the rotational axis of said roll bar;

a housing member connected to the top end of the support arm, said housing including means defining a clevis;

an axle shaft upon which said roll bar is rotationally mounted, the axle shaft extending through the sleeve member, the axle shaft including means adjacent an outer end thereof creating a yoke type connection of the axle shaft to the clevis of said housing member to allow said axle shaft to pivot with respect to said housing member;

a first spring clutch having an end contacting said axle shaft and having a plurality of coils wound around the sleeve member in a direction for constricting around said sleeve member to restrain rotation of the roll bar in a first rotational direction and for allowing rotation in a second rotational direction opposite to the first rotational direction, said first spring clutch also having a tang end which extends freely from a coil of the first spring clutch, the tang end being the opposite end of said spring clutch from the end contacting the axle shaft;

a second spring clutch having an end contacting said axle shaft and having a plurality of coils wound around the sleeve member in a direction for constricting around said sleeve member to restrain rotation of the roll bar in the second rotational direction and for allowing rotation in the first rotation direction, said second spring clutch also having a tang end which extends freely from a coil of the second spring clutch, the tang end being the opposite end of said spring clutch from the end contacting the axle shaft;

a selector member pivotably connected to the housing member for selective movement into first and second positions, said selector member operatively contacting and moving the tang end of the first spring clutch in the first position of the selector member to rotate the coils of the first spring clutch a predetermined amount in the direction opposite to that which the coils are wound on the sleeve member to inhibit constricting of the coils of the first spring clutch around the sleeve member, said selector lever operatively contacting and moving the tang end of the second spring clutch in the second position of the selector member to rotate the coils of the second spring clutch a predetermined amount in the direction opposite to that which the coils are wound on the sleeve member to inhibit constricting of the coils of the second spring clutch around the sleeve member.

22. An invention as defined in claim 21 wherein:

said axle shaft further includes a cylindrical grip collar axially spaced adjoining to the sleeve member and having an outer diameter substantially the same as the diameter of the sleeve member; and at least one coil of said first spring clutch is wound around said grip collar.

23. An invention as defined in claim 21 wherein said housing member includes a cup-shaped portion facing toward the end of said roll bar, the cup-shaped portion receiving therein at least a portion of said axle shaft and a portion of at least one of said spring clutches and a portion of said selector member, the cup-shaped portion also defining the clevis to which the axle shaft is connected by said yoke type connection means.

24. An invention as defined in claim 21:

wherein said support arm comprises first and second support members telescopingly connected together, the housing member connected at one end of the first support member;

further comprising a handle assembly connected at the other end of said first support arm, said handle assembly including a handle connected for selective movement into first and second operative positions; and further comprising means extending along the first support member and connecting said handle with said selector member for moving the selector member to the first and second positions upon said handle being moved to the first and second operative positions, respectively.

25. An invention as defined in claim 24 wherein:

said selector member includes an actuator arm contacting the tang ends of said clutch springs, and a selector member shaft rotationally retained by said housing member and connected to the actuator arm, and a pulley connected to the selector member shaft; and said means connecting said handle with said selector member comprises a cable connected at one end to said handle and connected at the other end around said pulley.

26. An invention as defined in claim 24 wherein:

said handle assembly further including support locking means for selectively locking the first and second support members in a fixed position relationship with one another to selectively fix the length of the support arm; and said support locking means being operative upon movement of said handle into one operative position to lock the support members in the fixed position relationship and being operative upon movement of said handle into the other operative position to release the fixed position relationship of the support members and allow the support members to move telescopically with respect to one another.

27. An invention as defined in claim 26 wherein:

the second support member includes a plurality of holes formed therein at intervals along a segment of its length; and said support locking means comprises a locking pin connected to extend from the handle assembly into a selected one of the holes in the second support member to lock the second support member in a selected fixed position with respect to the first support member, said locking pin operatively connected to said handle to be retracted from within the hole in the second support member upon movement of said handle from one operative position to another operative position.

28. An invention as defined in claim 27 wherein:

said handle assembly comprises means biasing said locking pin toward the extended position; and said locking pin is connected to said handle by connection means which retracts said locking pin from the extended position and allows said locking pin biasing means to extend said locking pin.

29. An invention as defined in claim 21 wherein said wind-up spring comprises:

a rectangular length of sheet spring material connected at one longitudinal end to the axle shaft and coiled generally radially about the axle shaft and operatively connected at the other longitudinal end thereof to said roll bar.

30. An invention as defined in claim 29 further comprising:

a torque tube having a hollow interior, and wherein: the roll bar is substantially hollow at its ends;

the torque tube is adapted to be received within the hollow end of the roll bar and retained therein to rotate in unison with the roll bar; and the other longitudinal end of the spring material is connected with the interior of the torque tube.

31. In a retractable awning assembly adapted to be connected to and extended from a vertical surface and having a roll bar upon which a canopy is rolled, a wind-up power spring for rotationally biasing the roll bar for rolling the canopy thereon, a support arm having a top end operatively connected to one end of the roll bar and a bottom end adapted to pivotably connect to and disconnect from the vertical surface for positioning the bottom end on the vertical surface or a horizontal surface when the awning assembly is extended, an awning brace member having an outer end adapted for connection to the top end of the support arm upon said canopy being unrolled and the awning assembly extended, and an improved latching mechanism for selectively pivotably connecting the bottom end of the support arm to the vertical surface and disconnecting the bottom end from the support surface comprising, in combination:

a catch piece pivotably connected for movement to first and second positions, the catch piece operatively retaining the bottom end of the support arm to the vertical support surface in a first pivoted position and operatively releasing the bottom end of the support arm in a second pivoted position; and means defining a receptacle for receiving the outer end of the brace member therein, the outer end of the brace member operatively contacting said catch piece to prevent movement into the second pivoted position when the bottom end is received in the receptacle.

32. An invention as defined in claim 31 wherein:

said latching mechanism further comprises a bracket adapted to be permanently connected to the vertical support surface, the catch piece being pivotably connected to the bracket; and a shelf extension of said bracket extending outward from the vertical support surface and adapted to guide the bottom end of said support arm into a connection relationship with said catch piece.

33. In a retractable awning assembly having a roll bar upon which a canopy is rolled, the roll bar being substantially hollow at its ends, a support arm having a top end operatively connected to one end of the roll bar and a bottom end for contacting a support surface, and an improved wind-up spring for rotationally biasing the roll bar for rolling the canopy thereon comprising:

a length of sheet spring material operatively connected at one longitudinal end to the support arm and coiled within the hollow end of the roll bar about the rotational axis of the roll bar and operatively connected at the other longitudinal end thereof to said roll bar.

34. An invention as defined in claim 33 further comprising:

a hollow torque tube received within the hollow end of the roll bar and rigidly retained therein to rotate in unison with the roll bar, the other end of the spring material being connected to the torque tube within its hollow interior.

35. An invention as defined in claim 34 further comprising:

an end cap piece rigidly connected to the torque tube; and an axle shaft connected to the top end of the support arm and extending into the hollow end of the roll bar, the roll bar rotating about the axle shaft; and wherein:

the end cap piece including bearing means at the rotational axis of the roll bar for connection to the axle shaft to support the roll bar from the axle shaft.

36. An invention as defined in claim 35 wherein one longitudinal end of the sheet spring material is connected to the axle shaft.

* * * * *